US009088092B2

(12) United States Patent
Kuo

(10) Patent No.: US 9,088,092 B2
(45) Date of Patent: Jul. 21, 2015

(54) ELECTRICAL CONNECTOR

(71) Applicant: HON HAI PRECISION INDUSTRY CO., LTD., New Taipei (TW)

(72) Inventor: Tzu-Fan Kuo, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 42 days.

(21) Appl. No.: 14/033,499

(22) Filed: Sep. 22, 2013

(65) Prior Publication Data

US 2014/0087576 A1 Mar. 27, 2014

(30) Foreign Application Priority Data

Sep. 21, 2012 (CN) ..... 2012 1 0354012

(51) Int. Cl.

| | |
|---|---|
| ***H01R 13/648*** | (2006.01) |
| ***H01R 13/52*** | (2006.01) |
| ***H01R 43/00*** | (2006.01) |
| *H01R 24/62* | (2011.01) |

(52) U.S. Cl.

CPC ..... *H01R 13/5202* (2013.01); *H01R 43/005* (2013.01); *H01R 24/62* (2013.01); *Y10T 29/49208* (2015.01)

(58) Field of Classification Search

CPC ..... H01R 23/6873
USPC ..... 439/607.4, 607.35, 607.58, 607.57
See application file for complete search history.

(56) References Cited

U.S. PATENT DOCUMENTS

| | | | | | |
|---|---|---|---|---|---|
| 3,521,823 | A | * | 7/1970 | Van Horssen | 264/262 |
| 3,840,841 | A | * | 10/1974 | Clark | 439/589 |
| 3,961,294 | A | * | 6/1976 | Hollyday | 333/182 |
| 4,795,372 | A | * | 1/1989 | Kobler | 439/607.01 |

FOREIGN PATENT DOCUMENTS

| | | |
|---|---|---|
| CN | 202076578 | 12/2011 |
| TW | I248236 | 1/2006 |
| TW | M439928 | 10/2012 |

* cited by examiner

*Primary Examiner* — Phuong Dinh
(74) *Attorney, Agent, or Firm* — Wei Te Chung; Ming Chieh Chang

(57) ABSTRACT

An electrical connector, comprises: an insulative housing; a plurality of contacts received into the insulative housing and having a plurality of soldering portion extending rearwardly and beyond a rear surface of the insulative housing; a metallic shell enclosing the insulative housing; and a cover formed on a rear end of the insulative housing and the metallic shell and sealed the rear surface of the insulative housing.

2 Claims, 4 Drawing Sheets

ELECTRICAL CONNECTOR

BACKGROUND OF THE INVENTION

1. Field of the Invention

The present invention relates generally to an electrical connector, and more particularly to an I/O (input/output) port formed in an electrical device.

2. Description of the Prior Art

Some kinds of electrical connectors are widely used in personal computers, notebooks, multimedia players and other electrical devices for an I/O port to electrically connect with an external signal or power cable. In some environment, the electrical device needs to meet waterproof requirement. Thus, the electrical connector as an I/O port formed in the electrical device also needs to be waterproof.

Nowadays, an I/O electrical connector comprises an insulative insulative housing defining a plurality of receiving passageways, a plurality of contacts received in the corresponding receiving passageways and a metallic metallic shell enclosing the insulative insulative housing. A plurality of rear ends of the contacts extends beyond a rear surface of the insulative insulative housing. It should be noted that each of receiving passageway is not fully sealed by a corresponding contact. Thus, a gap is formed between a contact and a corresponding receiving passageway where the contact received into. In addition, a gap is also formed between the insulative insulative housing and the metallic metallic shell. During a using process of the electrical device, the water vapor or liquid will be entered into an internal room of the electrical device through above said gaps. As a result, the electrical device will be damaged and not work in a normal state.

Hence, in this art, an electrical connector to overcome the above-mentioned disadvantages of the prior art will be described in detail in the following embodiment.

BRIEF SUMMARY OF THE INVENTION

A primary object, therefore, of the present invention is to provide an electrical connector with simple structure and waterproof function.

In order to implement the above object and overcome the above-identified deficiencies in the prior art, an electrical connector, comprises: an insulative housing; a plurality of contacts received into the insulative housing and having a plurality of soldering portion extending rearwardly and beyond a rear surface of the insulative housing; a metallic shell enclosing the insulative housing; and a cover formed on a rear end of the insulative housing and the metallic shell and sealed the rear surface of the insulative housing.

Other objects, advantages and novel features of the invention will become more apparent from the following detailed description of a preferred embodiment when taken in conjunction with the accompanying drawings.

DETAILED DESCRIPTION OF THE INVENTION

Figure 1:
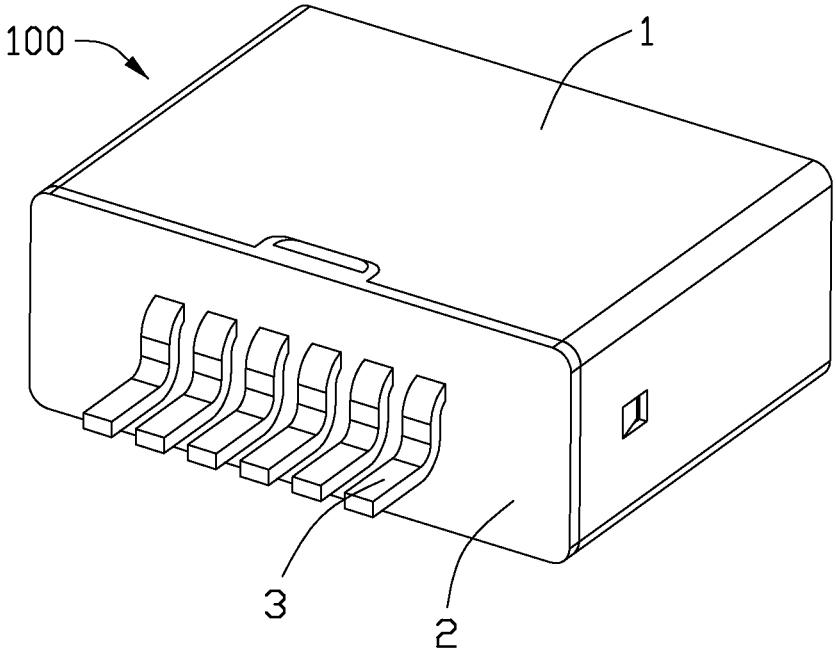
FIG. 1 is an assembled, perspective view of an electrical connector.

Reference will now be made in detail to a preferred embodiment of the present invention.

Referring to FIGS. 1 to 4, an electrical connector 100 comprises a metallic shell 1, an insulative housing 2 enclosed in the metallic shell 1, a plurality of contacts 3 received in the insulative housing 2 and a cover 4 formed on a rear end of the insulative housing 2.

Figure 3:
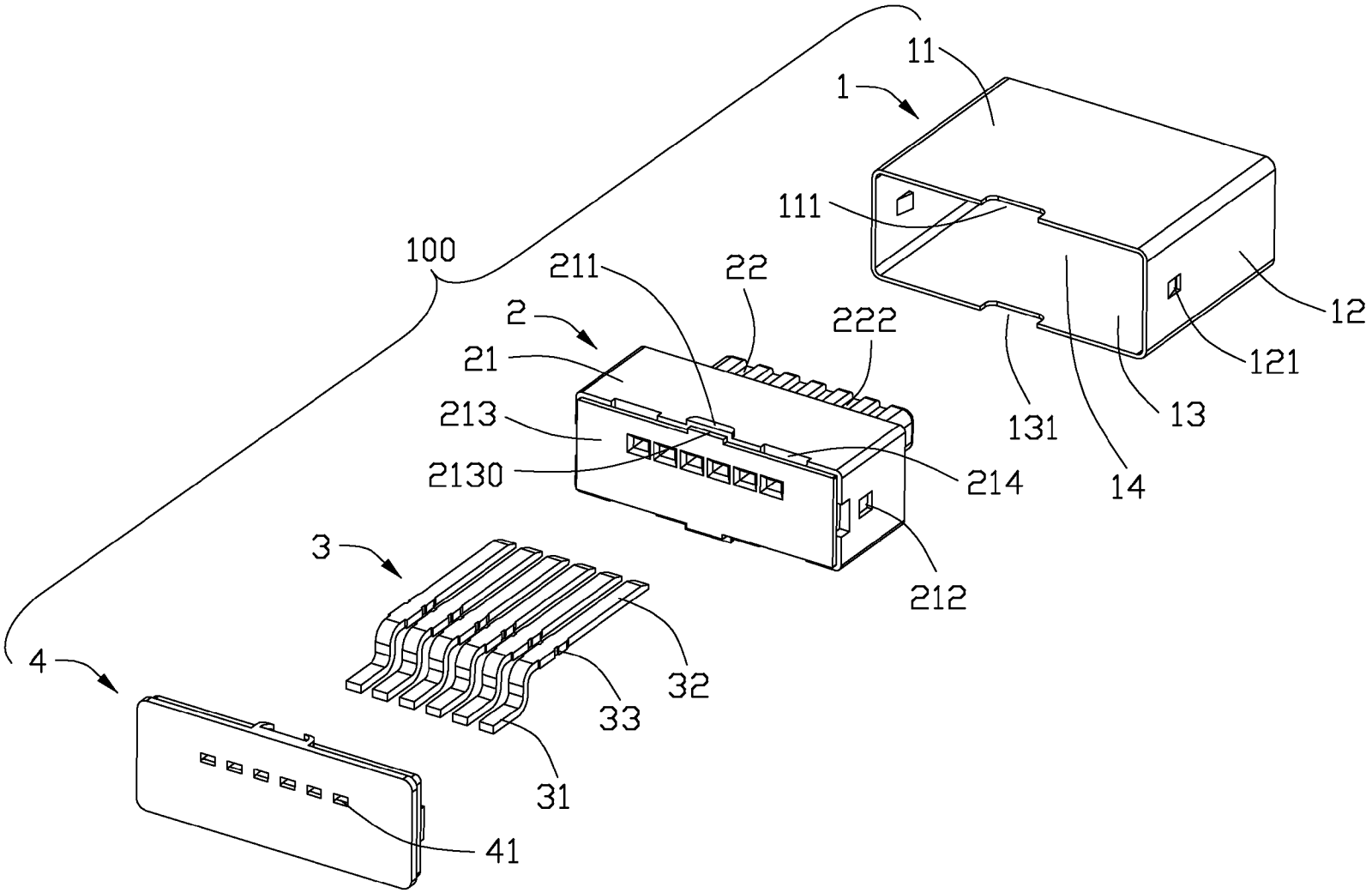
FIG. 3 is an exploded, perspective view of the electrical connector.
Figure 4:
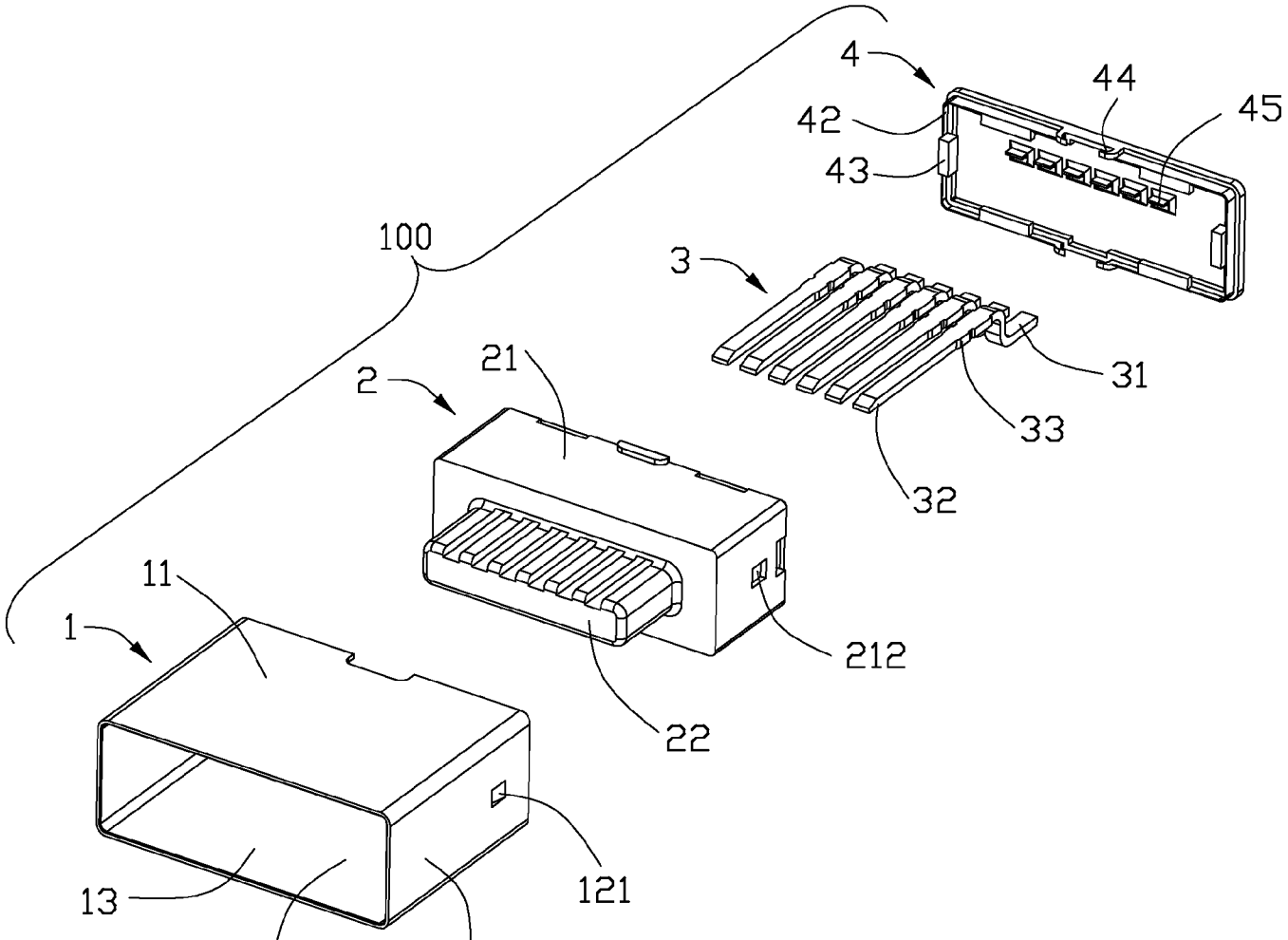
FIG. 4 is similar to FIG. 3, but viewed from another direction.

Referring to FIGS. 3 to 4, the metallic shell 1 comprises an upper wall 11, two side walls 12 respectively extending downwardly from two side of the upper wall 11 and a lower wall 13 connected to the two side walls 12 and paralleled with the upper wall 11. The upper wall 11 and the lower wall 13 respectively defines an indentation 111, 131 formed on a rear edge thereof. The metallic shell 1 defines a receiving cavity 14 formed by the upper wall 11, two side walls 12 and the lower wall 13 for receiving the insulative housing 2 and mating to a complementary connector (not shown). Each side wall 12 comprises an elastic tab 121 extending into the receiving cavity 14 for engaging with insulative housing 2.

Figure 2:
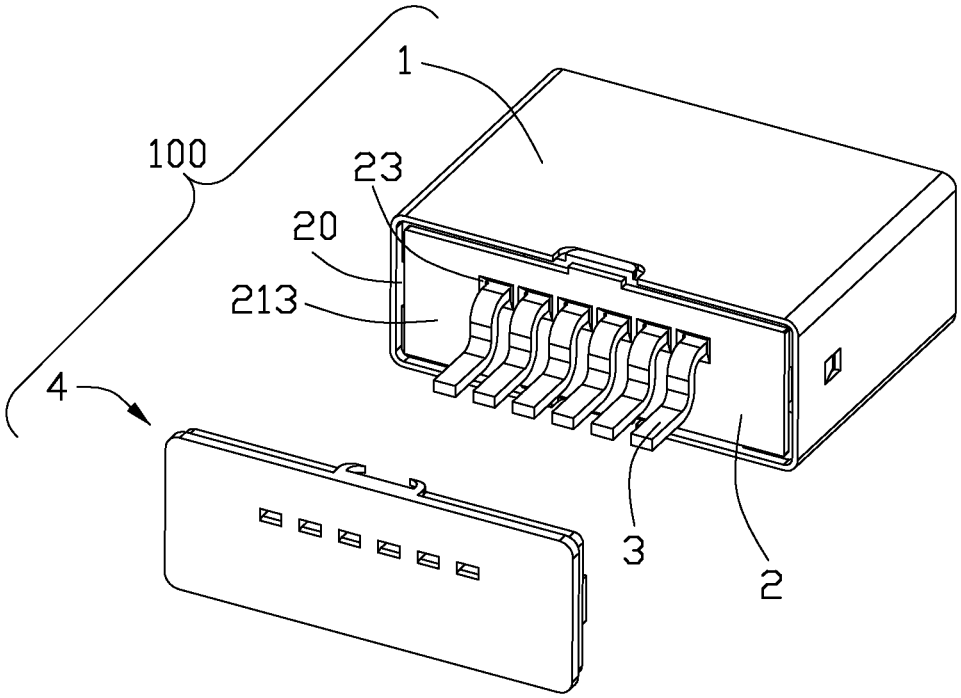
FIG. 2 is a partial exploded, perspective view of FIG. 1.

Referring to FIGS. 2 to 4, the insulative housing 2 comprises a base portion 21 and a tongue portion 22 extending forwardly from the base portion 21. The base portion 21 defines two protrusions 211 respectively formed on a top and bottom surfaces thereof for cooperating with two indentations 111, 131. The base portion 21 further defines two recesses 212 formed on two lateral surfaces thereof for cooperating with two elastic tabs 121 to achieve an engagement between the insulative housing 2. The tongue portion 22 defines a plurality of passageways 222 formed on an upper surface thereof and extending to a rear surface of the insulative housing 2. The insulative housing 2 further comprises an emboss portion 213 extending rearwardly from a rear surface of base portion 21, and a plurality of cutouts 214 formed on a rear periphery edge of the base portion 21 and surrounding the emboss portion 213. The emboss portion 213 comprises two flanges 2130 respectively formed on top and bottom surfaces thereof. A annular slot 20 is formed between an outer periphery surface of the emboss portion 213 and an inner periphery surface of the metallic shell 1. A plurality of gaps 23 are respectively formed between the plurality of contacts 3 and the corresponding passageways 222.

Referring to FIG. 3, each of contact 3 comprises a soldering portion 31 formed on a rear thereof, a mating portion 32 formed on a front end thereof and a retaining portion 33 connecting the soldering portion 31 and the mating portion 32.

Referring to FIGS. 3 to 4, a cover 4 is formed on the rear surface of the insulative housing 2 through over-molding process and engaged with the insulative housing 2. A plurality of gaps 23 are fully filled with a plurality of portions of the cover 4. And the annular slot 20 is also fully filled with a portion of the cover 4. A portion of the cover 4 is engaged with the two protrusions 211 and a plurality of cutouts 214 of the base portion 21. A portion of the cover 4 is engaged with two flanges 2130 of the emboss portion 213. The cover 4 defines a plurality of holes 41 respectively corresponding to the plurality of passageways 222 in a front-to-rear direction. An annular portion 42 is formed on a front surface of the cover 4 and filled into the annular slot 20. A plurality of protruding portions 45 are respectively formed on the front surface of the cover 4 and formed around the holes 41 for filling into the passageways 222. A plurality of projections 43 are formed on an inner side of the annular portion 42 to cooperated with the corresponding cutouts 214. Two arm portions 44 are respectively formed on an outer side of the annular portion 42 for engaging with two protrusions 211.

Referring to FIGS. 1 to 4, the assembling process of the electrical connector 100 made in according to the present invention starts from assembling the plurality of contacts 3 to the insulative housing 2. The mating portion 32 and the retaining portion 33 of each of the contact 3 are both received into the passageway 222. And, the soldering portion 31 of each of the contact 3 extends rearwardly beyond the rear surface of the insulative housing 2. Then, the insulative housing is inserted into the cavity 14 of the metallic shell 1. A cover 4 is formed on the rear surface of the insulative housing 2 and engaged with the insulative housing 2 through over-molding process. After the above assembling steps, the entire process of assembling of the electrical connector 100 is finished.

As the annular slot 20 and a plurality of gaps 23 are respectively fully filled with the annular portion 42 and the protruding portions 45 of the cover 4, so the water vapor or liquid will not be entered into an internal room of an electrical device through above said annular slot 20 and gaps 23 of the electrical connector 100. Thus, the electrical connector 100 has waterproof function. At the same time, the electrical connector 100 has simple structure and easily to be manufactured.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector, comprising:

an insulative housing;

a plurality of contacts received into the insulative housing and having a plurality of soldering portion extending rearwardly and beyond a rear surface of the insulative housing;

a metallic shell enclosing the insulative housing; and a cover formed on a rear end of the insulative housing and the metallic shell and sealing the rear surface of the insulative housing, wherein the insulative housing comprises an emboss portion, and an annular slot is formed between an outer periphery surface of the emboss portion and an inner surface of the metallic shell, and the annular slot is fully filled with an annular portion of the cover, wherein the insulative housing defines a plurality of passageways, the plurality of contacts are respectively received into the corresponding passageways, a plurality of gaps respectively formed between the plurality of contacts and the corresponding passageways, and the plurality of gaps are respectively fully fill with a plurality of protruding portions of the cover, wherein the cover is formed by an over-molding process, the insulative housing further comprises a base portion and a tongue portion extending forwardly from the base portion, the emboss portion extends rearwardly from the base portion, wherein metallic shell defines an upper wall, a lower wall and two lateral walls respectively connected with the upper wall and the lower wall, wherein the base portion defines two recesses formed at two lateral surfaces thereof, the two lateral walls of the metallic shell defines two elastic tabs cooperated with the two recesses to achieve an engagement between the insulative housing and the metallic shell, wherein the base portion further defines two protrusions respectively formed on top and bottom surfaces, the metallic shell defines two indentations respectively formed on the upper and lower wall and cooperated with the two protrusions, wherein the emboss portions defines two flanges respectively formed on top and bottom surfaces and located in back of the two protrusions, the cover defines two arm portions respectively engaged with the protrusions and the flanges, wherein base portion defines a plurality of cutouts formed on a rear periphery edge thereof, the cover defines a plurality of projections cooperated with the plurality of corresponding cutouts.

2. A method of making a waterproof electrical connector, comprising steps of:

providing an insulative housing with a front mating port and a rear connecting port with a plurality of passageways extending therethrough in a front-to-back direction;

forwardly inserting a plurality of contacts into the rear openings of corresponding passageways, respectively, from the connecting port, wherein each of said contacts defining a Z like tail portion with an upper horizontal section extending rearwardly from the rear opening of the corresponding passageway, a lower horizontal section for surface mounting to a printed circuit board, and a standing section linked between said upper and lower horizontal sections, said standing section is spaced from a rear face of the housing with a gap;

providing a hollow metallic shell and forwardly assembling the housing into the shell; and applying an insulative cover plate upon the connecting port in an upstanding manner via an overmolding process to cover said rear openings of the passageways, wherein said cover plate fills the gaps to provide support against the standing sections, wherein the cover plate includes a circumferential flange forwardly extending from an inner face thereof.

* * * * *